US011543765B2

(12) United States Patent
Fujiwara

(10) Patent No.: US 11,543,765 B2
(45) Date of Patent: Jan. 3, 2023

(54) FIXING DEVICE AND IMAGE FORMING APPARATUS INCORPORATING SAME

(71) Applicant: Hitoshi Fujiwara, Kanagawa (JP)

(72) Inventor: Hitoshi Fujiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/529,306

(22) Filed: Nov. 18, 2021

(65) Prior Publication Data

US 2022/0276593 A1 Sep. 1, 2022

(30) Foreign Application Priority Data

Feb. 26, 2021 (JP) ..... JP2021-030700

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/5045* (2013.01); *G03G 2215/2038* (2013.01)

(58) Field of Classification Search
None
See application file for complete search history.

(56) References Cited

U.S. PATENT DOCUMENTS

2010/0202810 A1* 8/2010 Hasegawa ..... G03G 15/2064 399/329
2018/0217540 A1 8/2018 Murakami et al.
2021/0278790 A1 9/2021 Furuichi et al.

FOREIGN PATENT DOCUMENTS

| | | |
|---|---|---|
| JP | 8-044225 | 2/1996 |
| JP | 2018-124426 | 8/2018 |
| JP | 2020-052345 | 4/2020 |
| JP | 2020-101674 | 7/2020 |

* cited by examiner

*Primary Examiner* — Quana Grainger
(74) *Attorney, Agent, or Firm* — Xsensus LLP

(57) ABSTRACT

A fixing device includes a fixing rotator, a heater, a pressure rotator, a stay, a biasing member fixed to the stay, and a nip formation pad. The nip formation pad is supported by the stay, disposed inside the fixing rotator, and forms a nip. The nip formation pad includes at least one engaged portion at a position other than both ends of the nip formation pad or engaged portions at both ends of the nip formation pad. The at least one engaged portion engages an engaging portion in the stay to generate a first rotational moment. The engaged portions at both ends engage engaging portions in the stay to generate a second rotational moment. Each rotational moment is smaller than a rotational moment generated by engagement between an engaging portion in the stay and an engaged portion at only one end of the nip formation pad.

15 Claims, 4 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-030700, filed on Feb. 26, 2021 in the Japan Patent Office, the entire disclosure of which is incorporated by reference herein.

BACKGROUND

Technical Field

Embodiments of the present disclosure generally relate to a fixing device and an image forming apparatus incorporating the fixing device.

Related Art

Image forming apparatuses such as a copier, a printer, a facsimile machine, and a multifunction peripheral of them include various types of fixing devices. For example, a heat roller type fixing device includes a fixing roller and a pressure roller as two rotators. The fixing roller includes a heat source such as a halogen lamp inside the fixing roller to heat the fixing roller. The pressure roller is pressed against the fixing roller to form a fixing nip. These two rollers rotate to pass a recording medium such as a paper sheet or an overhead projector (OHP) sheet bearing an unfixed toner image through the fixing nip. In the fixing nip, the toner image is melted and fixed on the recording medium.

Recently, it is desired to reduce energy consumption of the fixing device and shorten a warm-up time. A heating device including an endless belt such as a thin film or the like decreases a thermal capacity of the fixing device and effectively transfers heat to the recording medium to greatly shorten the warm-up time (as a result, a first print time). The above-described fixing device is referred to as an on-demand type fixing device and is widely employed.

One type of fixing device as described above includes a fixing member such as a thin fixing belt having a low thermal capacity and a planar heater including a base and a resistive heat generator to heat the fixing member. The planar heater includes, for example, a base extending in a width direction of the fixing member and a plurality of resistive heat generators electrically coupled each other on the base.

The planar heater is held by, for example, a heater holder that also serves as a nip formation member. The nip formation member is held by a reinforcing member (a stay) that receives pressure from the pressure roller.

SUMMARY

This specification describes an improved fixing device that includes an endless fixing rotator, a heater, a pressure rotator, a stay, a biasing member, and a nip formation pad. The heater heats the endless fixing rotator. The pressure rotator contacts an outer surface of the endless fixing rotator. The biasing member has one end fixed to the stay. The nip formation pad is supported by the stay, disposed inside a loop of the endless fixing rotator, and forms a nip between the endless fixing rotator and the pressure rotator. The nip formation pad includes at least one engaged portion disposed at a position other than both ends of the nip formation pad in the longitudinal direction of the nip formation pad or engaged portions disposed at both ends of the nip formation pad in a longitudinal direction of the nip formation pad. The at least one engaged portion engages an engaging portion included in the stay to generate a first rotational moment. The engaged portions at both ends of the nip formation pad engage engaging portions included in the stay to generate a second rotational moment. Each of the first rotational moment and the second rotational moment is smaller than a rotational moment generated by engagement between an engaging portion included in the stay and an engaged portion disposed at only one end of the nip formation pad in the longitudinal direction of the nip formation pad.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
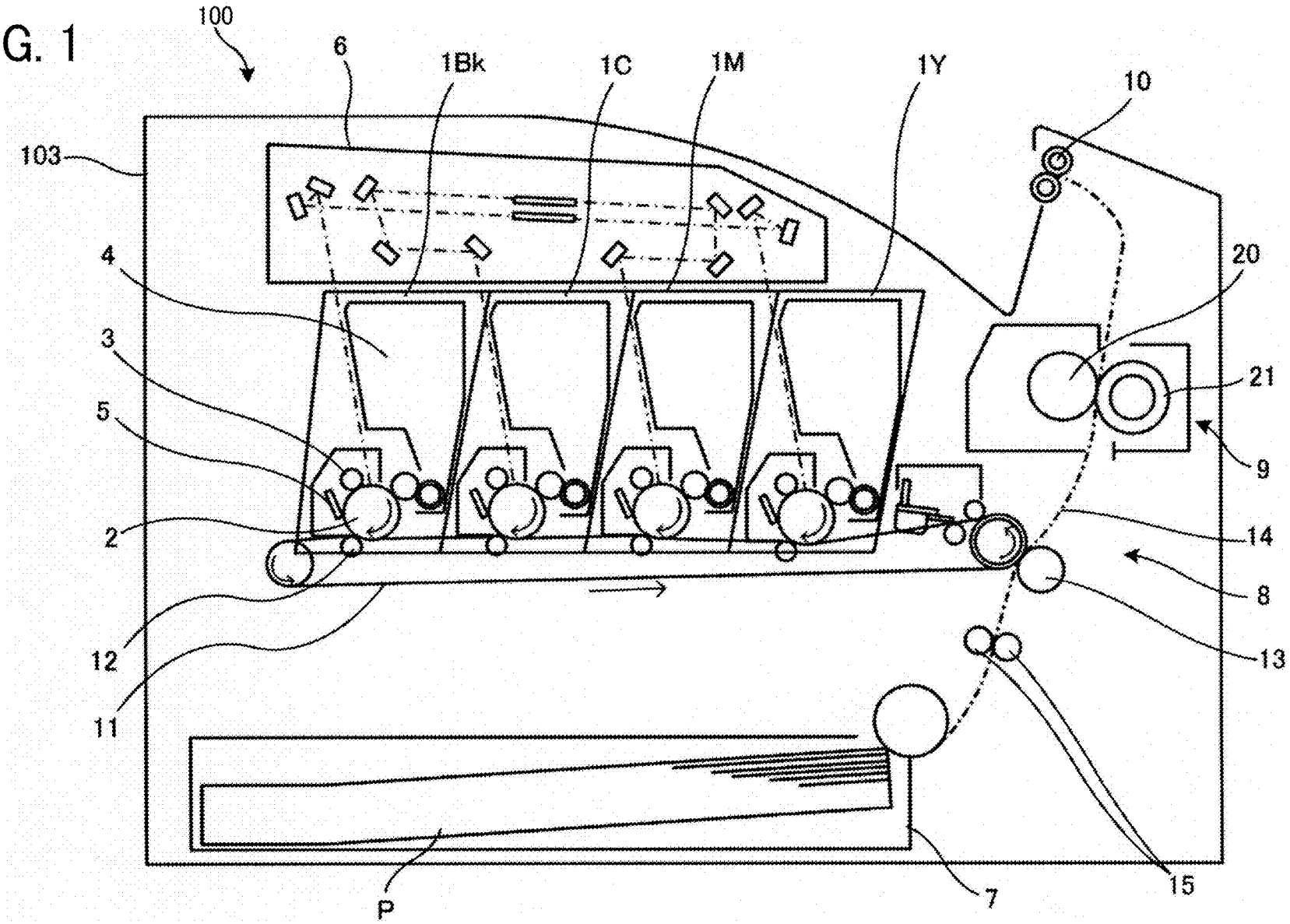
FIG. 1 is a schematic diagram illustrating a configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

A description is provided of a fixing device according to an embodiment of the present disclosure and an image forming apparatus incorporating the fixing device with reference to drawings. It is to be noted that the present disclosure is not to be considered limited to the following embodiments but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

In following embodiments, a recording medium is described as a paper sheet but not limited to this. Examples of the "recording medium" include an overhead projector (OHP) transparency sheet, a fabric, a metallic sheet, a plastic film, and a prepreg sheet including carbon fibers previously impregnated with resin. Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image formation" indicates an action for providing (i.e., printing) not only an image having a meaning, such as texts and figures on a recording medium, but also an image having no meaning, such as patterns on a recording medium.

The following describes the image forming apparatus according to the present embodiment.

FIG. 1 is a schematic diagram illustrating a configuration of the image forming apparatus according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like. The image forming apparatus 100 according to the present disclosure includes the fixing device according to the present disclosure.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar configuration except that the image forming units 1Y, 1M, 1C, and 1Bk contain developers in different colors, that is, yellow, magenta, cyan, and black, respectively, which correspond to color separation components for a color image. Specifically, each of the image forming units 1Y, 1M, 1C, and 1Bk includes a photoconductor 2 that is drum-shaped and serves as an image bearer, a charging device 3 to charge the surface of the photoconductor 2, a developing device 4 to supply toner as developer to the surface of the photoconductor 2 to form a toner image, and a cleaner 5 to clean the surface of the photoconductor 2.

The image forming apparatus 100 further includes an exposure device 6 to expose the surface of each photoconductor 2 to form an electrostatic latent image, a sheet feeder 7 to supply a sheet P as a recording medium, a transfer device 8 to transfer the toner image formed on each photoconductor 2 onto the sheet P, a fixing device 9 to fix the transferred toner image onto the sheet P, and a sheet ejection device 10 to eject the sheet P outside the image forming apparatus 100.

The transfer device 8 includes: an intermediate transfer belt 11 that is an endless belt stretched taut with multiple rollers and serves as an intermediate transferor; four primary transfer rollers 12 each as a primary transferor to transfer the toner image formed on each photoconductor 2 onto the intermediate transfer belt 11; and a secondary transfer roller 13 as a secondary transferor to transfer the toner image transferred onto the intermediate transfer belt 11 onto the sheet P. The primary transfer rollers 12 are in contact with the respective photoconductors 2 via the intermediate transfer belt 11.

Thus, the intermediate transfer belt 11 contacts each of the photoconductors 2, forming a primary transfer nip therebetween. On the other hand, the secondary transfer roller 13 contacts, via the intermediate transfer belt 11, one of the plurality of rollers around which the intermediate transfer belt 11 is stretched. Thus, a secondary transfer nip is formed between the secondary transfer roller 13 and the intermediate transfer belt 11.

The image forming apparatus 100 accommodates a sheet conveyance path 14 through which the sheet P fed from the sheet feeder 7 is conveyed. A timing roller pair 15 is disposed in the sheet conveyance path 14 at a position between the sheet feeder 7 and the secondary transfer nip defined by the secondary transfer roller 13.

Next, a description is given of printing processes performed by the image forming apparatus 100 with reference to FIG. 1.

When the image forming apparatus 100 receives an instruction to start printing, a driver drives and rotates the photoconductor 2 clockwise in FIG. 1 in each of the image forming units 1Y, 1M, 1C, and 1Bk. The charging device 3 charges the surface of the photoconductor 2 uniformly at a high electric potential.

Next, based on image data of a document read by a scanner or print data transmitted by a terminal device, the exposure device 6 exposes the surface of each of the photoconductors 2. Then, the potential of an exposed surface drops, and the electrostatic latent image is formed on each of the photoconductors 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 with the rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip.

The sheet P is supplied from the sheet feeder 7. The timing roller pair 15 temporarily halts the sheet P supplied from the sheet feeder 7. Thereafter, the timing roller pair 15 conveys the sheet P to the secondary transfer nip at a time when the full color toner image formed on the intermediate transfer belt 11 reaches the secondary transfer nip.

Accordingly, the full color toner image is transferred onto and borne on the sheet P. After the toner image is transferred from each of the photoconductors 2 onto the intermediate transfer belt 11, each of cleaners 5 removes residual toner on each of the photoconductors 2.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

Figure 2:
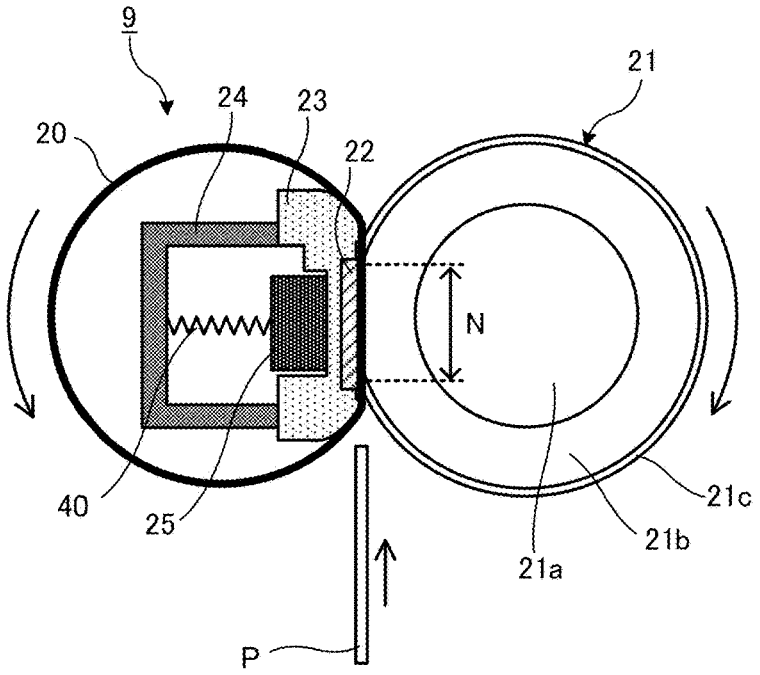
FIG. 2 is a schematic diagram illustrating a configuration of a fixing device in the image forming apparatus of FIG. 1.

Next, the fixing device 9 is described. FIG. 2 is a schematic diagram illustrating a configuration of the fixing device 9 according to the present embodiment of the present disclosure.

As illustrated in FIG. 2, the fixing device 9 according to the present embodiment includes a fixing rotator such as a fixing belt 20, a pressure rotator such as a pressure roller 21, a nip formation pad 23, a stay 24, a biasing member 40, and a heater 22. The fixing rotator such as the fixing belt 20 is a rotatable endless belt. The pressure rotator such as the pressure roller 21 is in contact with an outer circumferential surface of the fixing rotator such as the fixing belt 20. The nip formation pad 23 is disposed inside the loop of the fixing rotator such as the fixing belt 20 to form a nip N between the fixing rotator such as the fixing belt 20 and the pressure rotator such as the pressure roller 21. The stay 24 is a reinforcement member to support the nip formation pad 23. An end of the biasing member 40 is fixed to the stay 24. The heater 22 heats at least the fixing rotator such as the fixing belt 20. In the example illustrated in FIG. 2, the fixing device 9 further includes a temperature detector 25.

In FIG. 2, the rotation directions of the fixing belt 20 and the pressure roller 21 are indicated by arrows. A conveyance direction of the sheet P is indicated by arrow D in FIG. 3.

The fixing belt 20 includes a tubular base that is made of polyimide (PI) and has an outer diameter of 25 mm and a thickness in a range of from 40 μm to 120 μm, for example. The fixing belt 20 further includes a release layer serving as an outermost surface layer. The release layer is made of fluororesin, such as tetrafluoroethylene-perfluoroalkylvinylether copolymer (PFA) or polytetrafluoroethylene (PTFE), and has a thickness in a range of from 5 μm to 50 μm to enhance durability of the fixing belt 20 and facilitate separation of the sheet P and a foreign substance from the fixing belt 20.

Optionally, an elastic layer that is made of rubber or the like and has a thickness in a range of from 50 μm to 500 μm may be interposed between the base and the release layer. The base of the fixing belt 20 may be made of heat resistant resin such as polyetheretherketone (PEEK) or metal such as nickel (Ni) and steel use stainless (SUS), instead of polyimide. An inner circumferential surface of the fixing belt 20 may be coated with polyimide, PTFE, or the like to produce a slide layer.

The pressure roller 21 having, for example, an outer diameter of 25 mm, includes a solid iron cored bar 21*a*, an elastic layer 21*b* on the surface of the bar 21*a*, and a release layer 21*c* formed on the outside of the elastic layer 21*b*. The elastic layer 21*b* is made of silicone rubber and has a thickness of 3.5 mm, for example.

Preferably, the release layer 21*c* is formed by a fluororesin layer having, for example, a thickness of approximately 40 μm on the surface of the elastic layer 21*b* to improve releasability. Instead of the pressure roller 21, a member such as an endless pressure belt may be used as the opposed member opposite the outer peripheral surface of the fixing belt 20.

The heater 22 extends in a longitudinal direction thereof throughout an entire width of the fixing belt 20 in a width direction, that is, an axial direction, of the fixing belt 20. The heater 22 contacts the inner circumferential surface of the fixing belt 20. The heater 22 may not contact the fixing belt 20 or may be disposed opposite the fixing belt 20 indirectly via a low friction sheet or the like. However, the heater 22 that contacts the fixing belt 20 directly enhances conduction of heat from the heater 22 to the fixing belt 20.

The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, the heater 22 contacts the inner circumferential surface of the fixing belt 20 advantageously. The heater 22 includes a base layer 50, a conductor layer that includes a heat generator 60, and an insulation layer 52, all of which are sequentially layered in this order from the nip formation pad 23 toward the nip N.

In the present embodiment, the nip formation pad 23 also serves as a heater holder holding the planar heater 22.

The shape and function of the nip formation pad 23 are not limited thereto. For example, the nip formation pad 23 may be a pad member in a fixing device of a direct heating (DH) fixing type or a free belt nip (FBN) type in which a halogen heater or the like directly heats the fixing rotator or may be a nip plate in a fixing device of a nip plate heating type.

The nip formation pad 23 and the stay 24 are disposed inside the loop formed by the fixing belt 20.

The stay 24 is configured by a channeled metallic member, and both side plates of the fixing device 9 support both end portions of the stay 24. The stay 24 supports a stay side face of the nip formation pad 23, that faces the stay 24 and is opposite a heater side face of the nip formation pad 23, that faces the heater 22. Accordingly, the stay 24 retains the heater 22 and the nip formation pad 23 to be immune from being bent substantially by pressure from the pressure roller 21, forming the fixing nip N between the fixing belt 20 and the pressure roller 21.

Since the nip formation pad 23 is subject to temperature increase by heat from the heater 22, the nip formation pad 23 is preferably made of a heat resistant material. The nip formation pad 23 made of heat-resistant resin having low heat conductivity, such as a liquid crystal polymer (LCP) or polyether ether ketone (PEEK), reduces heat transfer from the heater 22 to the nip formation pad 23 and provides efficient heating of the fixing belt 20.

The heat-resistant resin may be selected from LCP resin, phenol resin, fluorine resin, polyimide resin, polyamide resin, polyamide-imide resin, PEEK resin, polyether sulfone (PES) resin, polyphenylene sulfide (PPS) resin, perfluoroalkoxy alkane (PFA) resin, polytetrafluoroethylene (PTFE) resin, and tetrafluoroethylene hexafluoropropylene copolymer (4.6 fluoride) (FEP) resin. The nip formation pad 23 may be an extruded product made by extruding one of the above heat resistant resins in the longitudinal direction of the holder.

The pressure roller 21 and the fixing belt 20 are pressed against each other. Thus, the nip N is formed between the fixing belt 20 and the pressure roller 21. As a driving force is transmitted to the pressure roller 21 from a driver disposed in the body 103 of the image forming apparatus 100, the pressure roller 21 serves as a drive roller that drives and rotates the fixing belt 20.

The fixing belt 20 is thus driven and rotated by the pressure roller 21 as the pressure roller 21 rotates. While the fixing belt 20 rotates, the fixing belt 20 slides over the heater 22. In order to facilitate sliding of the fixing belt 20, a lubricant such as oil or grease may be interposed between the heater 22 and the fixing belt 20.

When printing starts, the driver drives and rotates the pressure roller 21, and the fixing belt 20 starts rotation in accordance with rotation of the pressure roller 21. Additionally, as power is supplied to the heater 22, the heater 22 heats the fixing belt 20. The temperature of the fixing belt 20 reaches a predetermined target temperature (e.g., a fixing temperature). The sheet P bearing the unfixed toner image is conveyed through the fixing nip N formed between the fixing belt 20 and the pressure roller 21 as illustrated in FIG. 2. The fixing belt 20 and the pressure roller 21 fix the unfixed toner image on the sheet P under heat and pressure.

Figure 3:
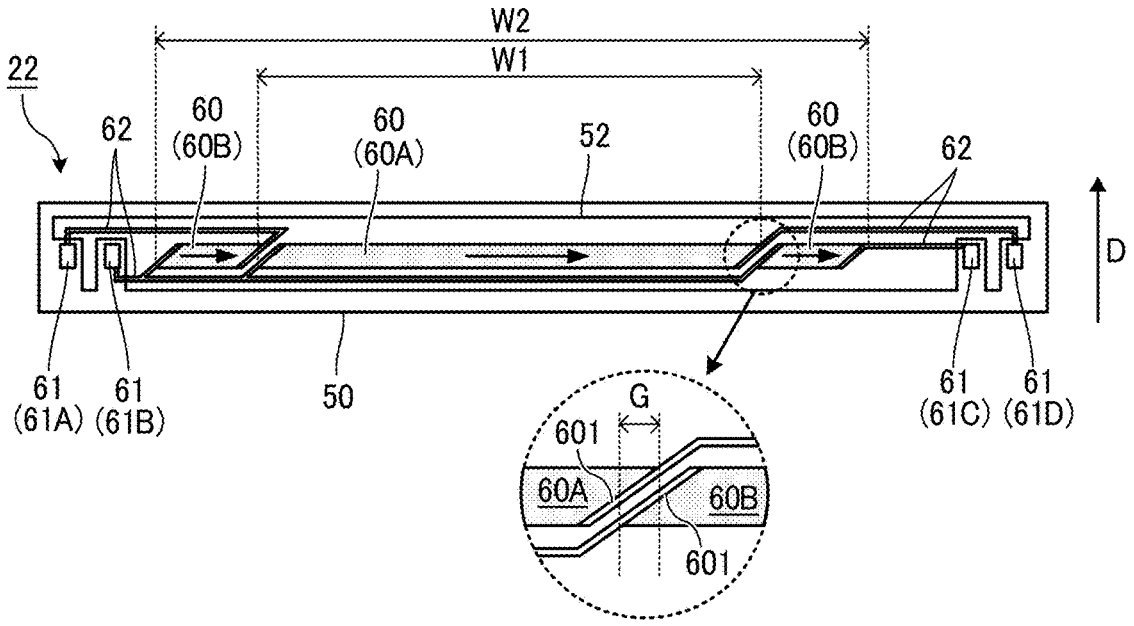
FIG. 3 is a plan view of an example of a heater in the fixing device of FIG. 2.

Next, the heater 22 is described. FIG. 3 is a plan view of the heater 22 as a heating member. Hereinafter, a front side of the heater 22 defines a side that faces the fixing belt 20 and the nip N. A back side of the heater 22 defines a side that faces the nip formation pad 23.

The heater 22 is constructed of a plurality of layers, that is, the base layer 50, the conductor layer, and the insulation layer 52, which are laminated. The base layer 50 is platy. The conductor layer is mounted on the front side of the base layer 50. The insulation layer 52 coats the front side of the conductor layer.

The conductor layer includes a plurality of heat generators 60, a plurality of electrodes 61, and a plurality of power supply lines 62. Each of the heat generators 60 includes a laminated, resistive heat generator. The plurality of electrodes 61 are disposed on both end portions of the base layer 50 in a longitudinal direction thereof. The plurality of power supply lines 62 couple the electrodes 61 to the heat generators 60.

As illustrated in FIG. 3, at least a part of each of the electrodes 61 is not coated by the insulation layer 52 and is exposed so that the electrodes 61 are coupled to the connector described below.

The base layer 50 is made of an insulating material such as glass or ceramic such as alumina or alumina nitride. Alternatively, the base layer 50 may be made of metal such as steel use stainless (SUS), iron, copper, or aluminum, and an insulation layer may be disposed between the base layer 50 and the conductor layer to surely insulate the conductor layer.

Since metal has an excellent durability when it is rapidly heated and is processed readily, metal is preferably used to reduce manufacturing costs. Among metals, aluminum and copper are preferable because aluminum and copper have high thermal conductivity and are less likely to cause uneven temperature. Stainless steel is advantageous because stainless steel is manufactured at reduced costs compared to aluminum and copper.

The insulation layer 52 is made of heat resistant glass. Alternatively, ceramic, polyimide (PI) or the like may be used as the material of the insulation layer 52.

For example, each of the heat generators 60 is produced as below. Silver-palladium (AgPd), glass powder, and the like are mixed into paste. The paste coats the base layer 50 by screen printing or the like. Thereafter, the base layer 50 is subject to firing. Alternatively, the heat generator 60 may be made of a resistive material such as a silver alloy (AgPt) and ruthenium oxide ($RuO_2$).

Each of the power supply lines 62 is made of a conductor having an electrical resistance lower than that of the heat generator 60. The power supply lines 62 and the electrodes 61 may be made of a material prepared with silver (Ag), silver-palladium (AgPd), or the like. Screen-printing such a material forms the power supply lines 62 and the electrodes 61.

Although the heat generator 60 is disposed on the front side of the base layer 50 in the present embodiment, alternatively, the heat generator 60 may be disposed on the back side of the base layer 50. In that case, since the heat of the heat generator 60 is transmitted to the fixing belt 20 through the base layer 50, it is preferable that the base layer 50 be made of a material with high thermal conductivity such as aluminum nitride. Making the base layer 50 with a material having a high thermal conductivity enables to sufficiently heat the fixing belt even if the heat generator 60 is disposed on the back side of the base layer 50.

According to the present embodiment, the heat generators 60, the electrodes 61, and the power supply lines 62 are made of an alloy of silver, palladium, or the like to attain a positive temperature coefficient (PTC) property, that is, to have a positive temperature coefficient of resistance. The PTC property defines a property in which the resistance value increases as the temperature increases, for example, a heater output decreases under a given voltage.

The heat generators 60 having the PTC property start quickly with an increased output at low temperatures and suppress overheating with a decreased output at high temperatures. For example, if a temperature coefficient of resistance (TCR) of the PTC property is in a range of from about 300 ppm/° C. to about 4,000 ppm/° C., the heater 22 is manufactured at reduced costs while retaining a resistance value needed for the heater 22.

The TCR is preferably in a range of from about 500 ppm/° C. to about 2,000 ppm/° C. The TCR is calculated by measuring the resistance value at 25° C. and 125° C. For example, if the temperature increases by 100° C. and the resistance value increases by 10%, the TCR is 1,000 ppm/° C.

According to the present embodiment, the three heat generators 60 are arranged in a longitudinal direction of the base layer 50. One of the three heat generators 60 is a central heat generator 60A as a first heat generator disposed at the center of the base layer 50 in the longitudinal direction, and the remaining two heat generators 60 are end heat generators 60B as second heat generators disposed adjacent to both ends of the central heat generator 60A in the longitudinal direction. The central heat generator 60A and the end heat generators 60B are configured to be independently controlled with respect to heat generation.

The plurality of electrodes 61 are referred to as a first electrode 61A, a second electrode 61B, a third electrode 61C, and a fourth electrode 61D in order from the left side in FIG. 3. Applying a voltage to the second electrode 61B and the fourth electrode 61D causes the central heat generator 60A to generate heat. Applying a voltage to the first electrode 61A and the second electrode 61B causes the left end heat generator 60B in FIG. 3 to generate heat, and applying a voltage to the second electrode 61B and the third electrode 61C causes the right end heat generator 60B in FIG. 3 to generate heat.

In addition, the first electrode 61A and the third electrode 61C are coupled in parallel outside the heater 22 and configured to be able to apply the voltage at the same time. Applying the voltage between the second electrode 61B and each of the first electrode 61A and the third electrode 61C enables both end heat generators 60B to generate heat at the same time. Each of arrows in FIG. 3 indicates a direction of current flowing in the longitudinal direction of each of the heat generators 60A and 60B.

When a width of the sheet P passing through the fixing device 9 is equal to or shorter than the width W1 of the central heat generator 60A, the central heat generator 60A generates heat. When the width of the sheet P passing through the fixing device 9 is equal to or longer than the width W1 of the central heat generator 60A, the end heat generators 60B generate heat in addition to the central heat generator 60A. As a result, the heater 22 can generate heat in a heat generation area corresponding to a size of a sheet conveyance area. Additionally, the width W1 of the central heat generator 60A is set to a width of a small sheet (for example, a width corresponding to A4 sheet: 215 mm). The width W2 of the heat generation area from one end heat generator 60B to the other end heat generator 60B is set to a width of a large sheet (for example, a width corresponding to A3 sheet: 301 mm). In the above-described configuration, turning off the end heat generators 60B prevents an excessive temperature rise in a non-sheet conveyance portion caused by many small sheets P passing through the fixing device. The above-described configuration can improve the productivity of printing because the above-described configuration does not need to reduce a pint speed to prevent the excessive temperature rise.

As illustrated in FIG. 3, each of the central heat generator 60A and the end heat generators 60B in the present embodiment has inclined portions 601 that are inclined with respect to a sheet passing direction that is the conveyance direction of the sheet P and disposed at both ends of each of the central heat generator 60A and the end heat generators 60B. The inclined portions 601 adjacent to each other at least partially overlap each other in the longitudinal direction of the heater 22 (that is the lateral direction in FIG. 3) and are disposed in the same region G (see the enlarged view in FIG. 3) in the longitudinal direction. Disposing the inclined portions 601 so as to overlap each other as described above reduces a temperature drop between the central heat generator 60A and the end heat generator 60B and reduces fixing unevenness in a width direction of the sheet.

Next, the temperature detector 25 is described. Temperature data detected by the temperature detector 25 is transmitted to a controller that controls heat generation of each of the central heat generator 60A and the end heat generators 60B. The controller separately controls the central heat generator 60A and the end heat generators 60B based on the transmitted temperature data. As a result, the temperature in the fixing nip N is controlled to be a predetermined target temperature (the fixing temperature).

Preferably, the temperature sensor of the temperature detector 25 is disposed in a region facing the central heat generator 60A having the width W1 in addition to facing a small sheet conveyance area.

Additionally, disposing the temperature sensor of the temperature detector 25 within a region corresponding to a sheet conveyance area of the smallest sheet among a plurality of sizes of sheets each having a smaller width than the width W1 of the central heat generator 60A enables the temperature detector 25 to detect temperatures of regions corresponding to all sizes of sheets passing the vicinity of the central heat generator 60A.

FIG. 2 illustrates an example of the temperature detector 25 attached to the nip formation pad 23. The temperature detector 25 is accommodated in an accommodating section 23*a* that is a through hole (a frame) or a groove disposed in the nip formation pad 23. The fixing device 9 may include a positioner in which inserting a convex engaging portion on the nip formation pad 23 into a concave engaging portion on the temperature detector 25 positions the temperature detector 25 with respect to the nip formation pad 23.

Setting the temperature detector 25 in the accommodating section 23*a* formed in the nip formation pad 23 causes the temperature detector 25 to be in contact with or adjacent to the heater 22. A high thermal conduction member made of aluminum, graphite, or the like may be disposed between the temperature detector 25 and the heater 22 so as to be in contact with each other via the high thermal conduction member (and an insulation sheet or the like).

The stay 24 serving as the reinforcement member supports a pair of coil springs serving as biasing members 40 that bias the temperature detector 25. The biasing member is not limited to the pair of coil springs and may be another type of spring or an elastic member such as rubber.

The biasing member 40 biases the temperature detector 25 toward the nip formation pad 23 and the heater 22, and the temperature detector 25 comes into contact with the heater 22 at a predetermined pressure.

One end of the biasing member 40 is fixed to the reinforcement member, and the other end of the biasing member 40 is fixed to the temperature detector 25. The other end of the biasing member 40 fixed to the temperature detector 25 is positioned by, for example, inserting the other end into a hole of a positioning protrusion or the like on the temperature detector 25 to prevent positional deviation or buckling and apply a stable contact pressure between the temperature detector 25 and the heater 22.

A first embodiment is described below.

Figure 4:
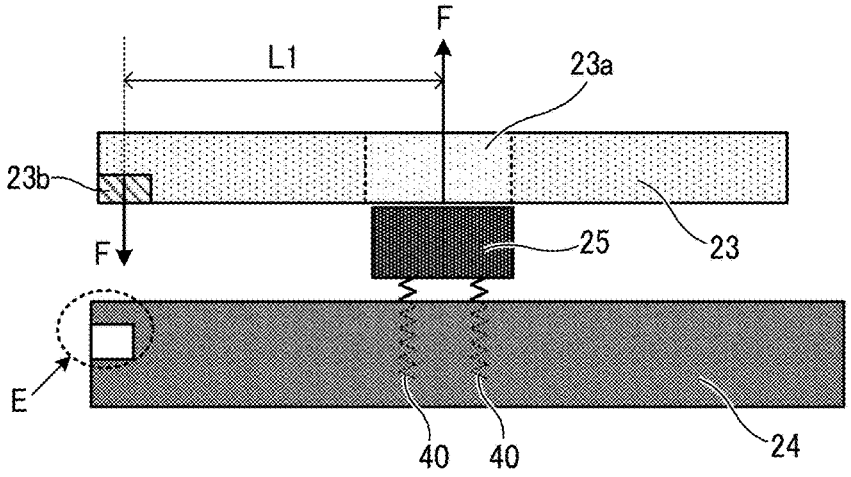
FIG. 4 is a schematic diagram illustrating engagement between a nip formation pad and a stay, according to a comparative embodiment.
Figure 5:
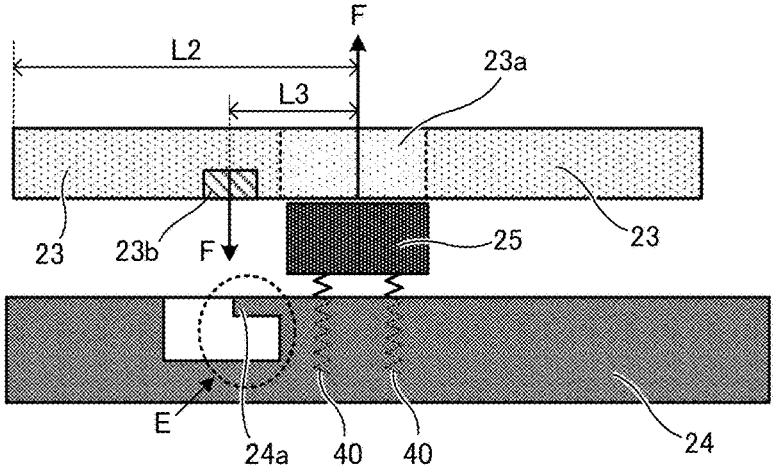
FIG. 5 is a schematic diagram illustrating engagement between the nip formation pad and the stay, according to a first embodiment.

With reference to FIGS. 4 and 5, the following describes engagement between the nip formation pad 23 and the stay 24 as the reinforcement member. FIG. 4 is a schematic diagram illustrating the engagement according to a comparative embodiment, and FIG. 5 is a schematic diagram illustrating the engagement according to the first embodiment of the present disclosure.

Each of the following drawings illustrates one side of the nip formation pad 23 extending in the longitudinal direction of the nip formation pad 23 and one side of the stay 24 as the reinforcement member extending in the longitudinal direction of the stay 24, but basically the opposite sides of the nip formation pad 23 and the stay 24 also have the same configuration.

The stay 24 as the reinforcement member according to the present embodiments has at least one engaging portion E engaging at least one engaged portion 23*b* of the nip formation pad 23. The nip formation pad 23 according to the present embodiments has either the engaged portions at both ends of the nip formation pad 23 or at least one engaged portion at a position other than both ends of the nip formation pad 23. In contrast, the nip formation pad 23 according to a comparative embodiment has the engaged portion 23*b* at only one end in the longitudinal direction of the nip formation pad 23. A rotational moment generated by the engagement between the nip formation pad 23 and the stay 24 according to the present embodiment is smaller than a rotational moment generated by the engagement between the nip formation pad 23 and the stay 24 according to the comparative embodiment.

The biasing member 40 pushes the nip formation pad 23 in a short-side direction of the nip formation pad 23 and in a direction away from the stay 24.

In other words, the biasing member 40 presses the temperature detector 25 that detects the temperature of the heater 22 against the nip formation pad 23.

The nip formation pad 23 has the accommodating section 23*a* that is the through hole to accommodate the temperature detector 25. Preferably, the inner wall of the accommodating section 23*a* is not in contact with the temperature detector 25.

As illustrated in FIG. 5, the fixing device according to the first embodiment satisfies the following relation.

$$L3<L2/2.$$

In the above, L2 is a distance in the longitudinal direction of the nip formation pad 23 from a pressing position at which the biasing member 40 presses against the nip formation pad 23 to one end of the nip formation pad 23 that is nearer to the pressing position than the other end of the nip formation pad 23, and L3 is a distance in the longitudinal direction from the pressing position to the engaged portion 23*b* of the nip formation pad 23.

The pressing position is a position at which a resultant force from the biasing member is considered to be applied to the nip formation pad 23 and may be a center position of an area pressed by the biasing member 40 in the longitudinal direction.

Setting the distance L3 smaller is preferable because the smaller distance L3 results in the smaller rotational moment generated by the engagement between the nip formation pad 23 and the stay 24 and applied to the nip formation pad 23.

In the comparative embodiment illustrated in FIG. 4, the following expression gives the rotational moment M0 at an engagement portion at which the engaging portion E of the stay 24 as the reinforcement member engages the engaged portion 23*b* of the nip formation pad 23.

$$M0=F\times L1.$$

In the above, F is a force of the biasing member 40 pressing the nip formation pad 23, and L1 is a distance in the longitudinal direction of the nip formation pad 23 from the pressing position to the engaged portion 23*b* disposed in one end of the nip formation pad 23.

In the first embodiment illustrated in FIG. 5, the following expression gives the rotational moment in the first embodiment.

$$M=F\times L3.$$

In the above, F is the force of the biasing member 40 pressing the nip formation pad 23, and L3 is a distance in the longitudinal direction of the nip formation pad 23 from the pressing position to the engaged portion 23*b* of the nip formation pad 23. The values of above-described rotational moments satisfy the relationship M0>M. This rotational moment M is referred to as a first rotational moment. The first rotational moment is defined as a rotational moment generated by engagement between at least one engaged portion disposed at a position other than both ends of the nip formation pad in the longitudinal direction of the nip formation pad and the engaging portion included in the stay.

In the fixing device 9 according to the first embodiment, the nip formation pad 23 has the engaged portion 23*b* that is engaged by the engaging portion of the stay 24 as the reinforcement member, and the engaged portion 23*b* is at a position on the nip formation pad 23 other than both ends of the nip formation pad 23. The rotational moment generated by the engagement between the nip formation pad 23 and the stay 24 according to the first embodiment is smaller than the rotational moment generated by the engagement between the nip formation pad 23 and the stay 24 according to the comparative embodiment in which the nip formation pad 23 has the engaged portion 23*b* at only one end of the nip formation pad 23.

Generally, when the nip formation pad 23 falls from the stay 24 as the reinforcement member, the nip formation pad 23 may contact and damage the inner circumferential surface of the fixing belt 20. Specifically, the nip formation pad 23 that has fallen from the stay 24 and has come into contact with the fixing belt 20 deforms the fixing belt 20 and causes plastic deformation like creases of the fixing belt 20 called a kink. The occurrence of the kink causes an abnormal image such as streaks. In addition, printing after the occurrence of the kink may cause breakage of the fixing belt.

According to the present embodiment, the above-described configuration stably holds the nip formation pad 23 engaged by the stay 24 as the reinforcement member and prevents the nip formation pad 23 from falling off during an assembly process or during transportation after assembly. Preventing the nip formation pad 23 from falling off prevents occurrence of the kink of the fixing belt and, as a result, prevents occurrence of the abnormal image or the breakage of the fixing belt that are caused by fall of the nip formation pad 23 during printing.

Second Embodiment

Figure 6:
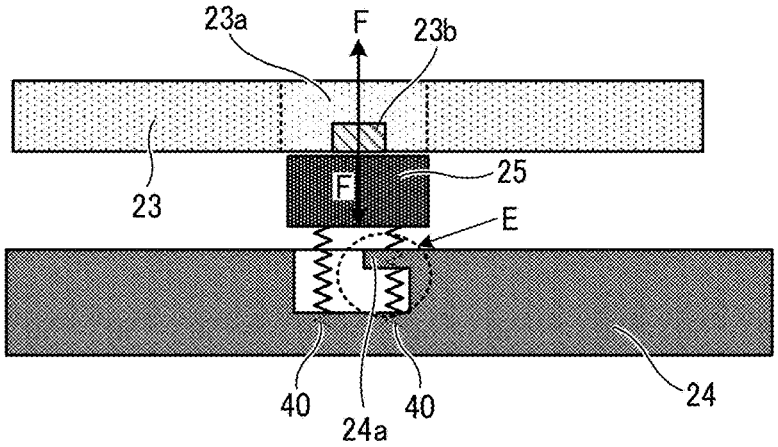
FIG. 6 is a schematic diagram illustrating engagement between the nip formation pad and the stay, according to a second embodiment.

With reference to FIG. 6, the following describes engagement between the nip formation pad 23 and the stay 24 as the reinforcement member according to the second embodiment.

Similar to the first embodiment, the stay 24 as the reinforcement member according to the second embodiment has the engaging portion E engaging the engaged portion 23*b* of the nip formation pad 23. The nip formation pad 23 according to the second embodiment has the engaged portion at the position other than both ends. A rotational moment generated by the engagement between the nip formation pad 23 and the stay 24 according to the second embodiment is smaller than the rotational moment generated by the engagement between the nip formation pad 23 and the stay 24 according to the comparative embodiment in which the nip formation pad 23 has the engaged portion 23*b* at only one end in the longitudinal direction of the nip formation pad 23. The rotational moment in the second embodiment is also the first rotational moment.

As illustrated in FIG. 6, in the second embodiment, the pressing position of the biasing member 40 overlaps the engaged portion 23*b* of the nip formation pad 23 when viewed in the short-side direction of the nip formation pad 23.

The above-described configuration generates forces in opposite directions at the engagement portion. The forces are balanced, and the first rotational moment becomes zero.

That is, the rotational moment in the second embodiment is smaller than the rotational moment in the comparative embodiment illustrated in FIG. 4.

As a result, similar to the first embodiment, the above-described configuration stably holds the nip formation pad 23 engaged by the stay 24 as the reinforcement member, prevents the nip formation pad 23 from falling off, and prevents a disadvantage caused by the fall of the nip formation pad 23.

Third Embodiment

The fixing device according to the third embodiment has the engagement portions along the longitudinal direction of the nip formation pad 23. In each of the engagement portions, the engaging portion E of the stay 24 as the reinforcement member engages the engaged portion 23*b* of the nip formation pad 23.

Figure 7:
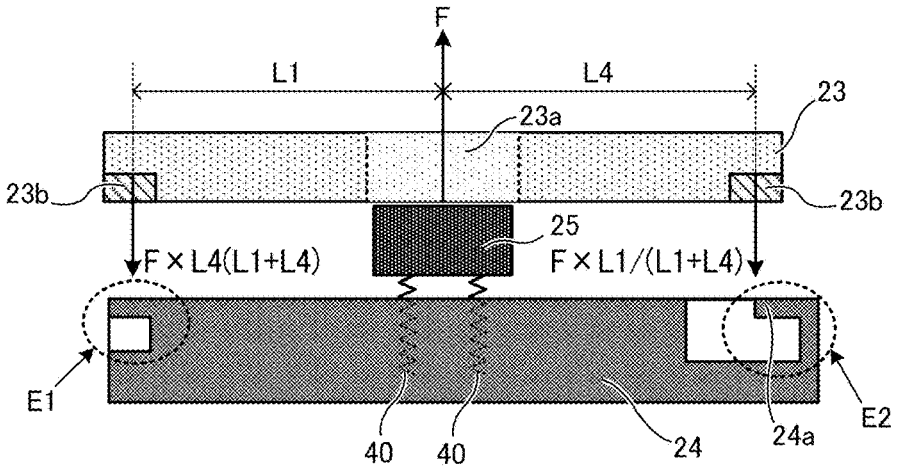
FIG. 7 is a schematic diagram illustrating engagement between the nip formation pad and the stay, according to a third embodiment.

With reference to FIG. 7, the following describes the engagement according to the third embodiment between the nip formation pad 23 and the stay 24 as the reinforcement member.

In the third embodiment, the nip formation pad 23 has a plurality of the engaged portions 23*b* in the longitudinal direction of the nip formation pad 23, and a plurality of engaging portions of the stay 24 engage the engaged portions 23*b*, respectively. A rotational moment generated by the engagement between the nip formation pad 23 and the stay 24 according to the third embodiment is smaller than the rotational moment generated by the engagement between the nip formation pad 23 and the stay 24 according to the comparative embodiment in which the nip formation pad 23 has the engaged portion 23*b* at only one end in the longitudinal direction of the nip formation pad 23.

As illustrated in FIG. 7, in the third embodiment, at least one first engagement portion is set on one half portion of the nip formation pad 23 in the longitudinal direction of the nip formation pad 23 from the pressing position of the biasing member 40 to one end of the nip formation pad 23, and at least one second engagement portion is set on the other half portion of the nip formation pad 23 in the longitudinal direction of the nip formation pad 23 from the pressing position of the biasing member 40 to the other end of the nip formation pad 23. The first and second engagement portions may be disposed both ends of the nip formation pad 23 in the longitudinal direction. In this case, the rotational moment is referred to as a second rotational moment. The second rotational moment is defined as a rotational moment generated by engagement between the engaging portions of the stay and the engaged portions disposed at both ends of the nip formation pad in the longitudinal direction. Therefore, the rotational moment generated by the engagement between the engaging portions of the stay and the engaged portions disposed at positions of the nip formation pad other than both ends of the nip formation pad is the first rotational moment.

The first engagement portion is in the left side of FIG. 7 with respect to the pressing position of the biasing member 40. At the first engagement portion, the engaging portion E1 of the stay 24 as the reinforcement member engages the engaged portion 23*b* of the nip formation pad 23, and the engaged portion 23*b* is at a distance L1 from the pressing position of the biasing member 40. In contrast, the second engagement portion is in the right side of FIG. 7 with respect to the pressing position of the biasing member 40. At the second engagement portion, the engaging portion E2 of the stay 24 as the reinforcement member engages the engaged portion 23*b* of the nip formation pad 23, and the engaged portion 23*b* is at a distance L4 from the pressing position of the biasing member 40.

The rotational moment M1 at the first engagement portion including the engaging portion E1 is obtained by the following expression.

$$M1=F\times L1-F\times L1/(L1+L4)\times(L1+L4)=0$$

The rotational moment M2 at the second engagement portion including the engaging portion E2 is obtained by the following expression.

$$M2=F\times L4-F\times L4/(L1+L4)\times(L1+L4)=0$$

As described above, the rotational moment generated by the engagement between the nip formation pad 23 and the stay 24 according to the third embodiment is smaller than the rotational moment generated by the engagement between the nip formation pad 23 and the stay 24 according to the comparative embodiment in which the nip formation pad 23 has the engaged portion 23*b* at only one end portion in the longitudinal direction of the nip formation pad 23.

As a result, similar to the first embodiment, the above-described configuration stably holds the nip formation pad 23 engaged by the stay 24 as the reinforcement member, prevents the nip formation pad 23 from falling off, and prevents a disadvantage caused by the fall of the nip formation pad 23.

Fourth Embodiment

The nip formation pad 23 and the stay 24 in the first and second embodiments described above have one engagement portion in the longitudinal direction, and the nip formation pad 23 and the stay 24 in the third embodiment has two engagement portions in the longitudinal direction.

The nip formation pad 23 and the stay 24 as the reinforcement member in the fourth embodiment has at least one engagement positioner in at least one of the engagement portions described above at which the engaging portion E of the stay 24 as the reinforcement member engages the engaged portion 23*b* of the nip formation pad 23. The engagement positioner positions the nip formation pad 23 on the stay 24 in response to the engagement between the nip formation pad 23 and the stay 24.

Sliding movement of the stay 24 and the nip formation pad 23 in the longitudinal direction assembles the nip formation pad 23 and the stay 24, and the nip formation pad 23 and the stay 24 are positioned and fixed after this assembling process.

In the fourth embodiment, at least one engagement portion includes the engagement positioner that engages and fixies the nip formation pad 23 and the stay 24.

Figure 9:
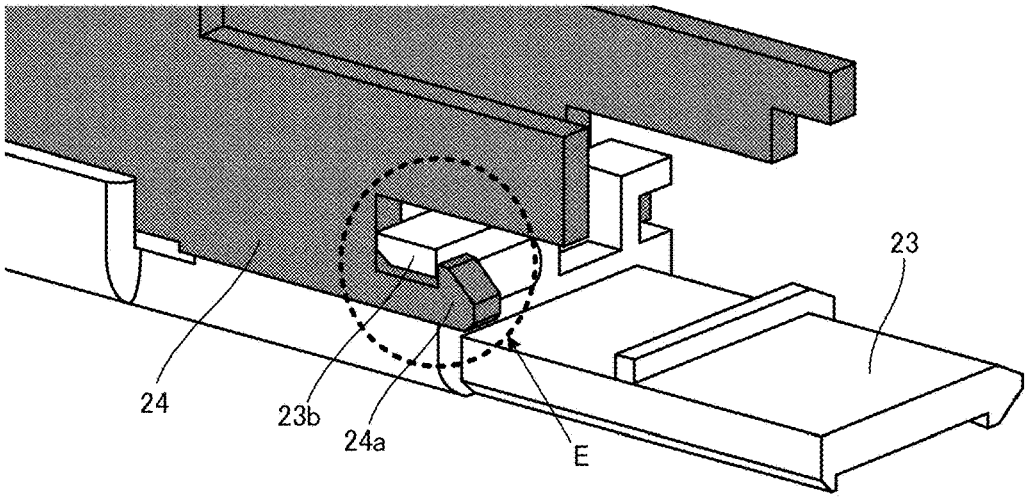
FIG. 9 is a perspective view of an example of an engagement portion engaged by a snap-fit manner.

With reference to FIG. 9, the following describes one example of the engagement positioner.

FIG. 9 is a partially enlarged view of an example of the engagement portion including the engagement positioner that is a snap-fit engaging portion 24*a* of the stay 24 snapping on and engaging with the engaged portion 23*b* of the nip formation pad 23.

For example, the engaging portion 24*a* of the stay 24 in the first embodiment illustrated in FIG. 5, the second embodiment illustrated in FIG. 6, and the third embodiment illustrated in FIG. 7 may be the snap-fit engaging portion 24*a* as illustrated in FIG. 9.

The engagement positioner is not limited to the snap-fit engaging portion. The engagement positioner is configured to allow relative sliding movement of the stay 24 and the nip formation pad 23 in the longitudinal direction to predetermined positions of the nip formation pad 23 and the stay 24 and restrict movement of the stay 24 and the nip formation pad 23 in the direction opposite to the direction of the relative sliding movement after the stay 24 and the nip formation pad 23 reach the predetermined positions.

The nip formation pad 23 has the accommodating section 23*a* that is the through hole to accommodate the temperature detector 25 detecting the temperature of the heater 22.

The accommodating section 23*a* is configured so that the inner wall of the accommodating section 23*a* does not abut on the temperature detector 25 during and after assembly.

Figure 8:
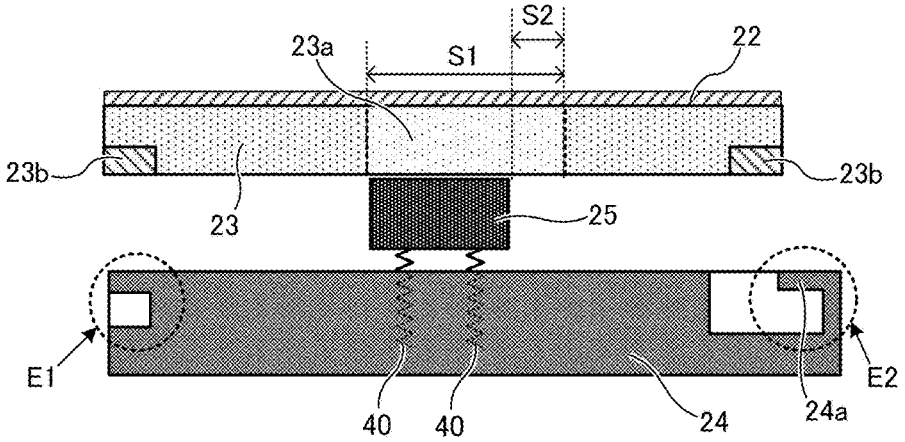
FIG. 8 is a schematic diagram illustrating engagement between the nip formation pad and the stay, according to a fourth embodiment.

For example, as illustrated in FIG. 8, the accommodating section 23*a* has the overall length S1 in the longitudinal direction including a length S2 for a space to avoid interference between the temperature detector 25 and the inner wall of the accommodating section 23*a* caused by the sliding movement of the nip formation pad 23 during assembly.

In other words, the accommodating section 23*a* has a radius in the longitudinal direction of the nip formation pad 23 larger than a radius in the short-side direction of the nip formation pad 23.

In the present embodiments, the nip formation pad 23 holds the planar heater 22 that heats the fixing belt 20. However, the above-described engagement manner between the stay 24 as the reinforcement member and the nip formation pad 23 may be applied to a fixing device using another heating method.

In the present embodiments, the biasing member 40 disposed on the stay 24 as the reinforcement member directly presses the nip formation pad 23 or presses the nip formation pad 23 via the temperature detector 25. As a result, the nip formation pad 23 is bent. Similarly, the stay 24 as the reinforcement member receives a load from the biasing member and is bent.

Therefore, preferably, the nip formation pad 23 or the stay 24 have a shape capable of adjusting the nip deviation due to bending described above.

For example, the stay 24 as the reinforcement member may have a shape in which a central portion in the longitudinal direction protrudes toward the nip formation pad 23 with respect to both ends in the longitudinal direction.

Alternatively, the nip formation pad 23 may have a shape in which a central portion in the longitudinal direction protrudes toward the stay 24 with respect to both ends in the longitudinal direction.

The fixing device according to the present disclosure having the engagement manners between the stay 24 as the reinforcement member and the nip formation pad 23 in the above-described embodiments prevents the nip formation pad 23 from falling off during the assembly process or during transportation after assembly and, as a result, prevents occurrence of the abnormal image or the breakage of the fixing belt that are caused by fall of the nip formation pad 23.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing device comprising:

an endless fixing rotator;

a heater configured to heat the endless fixing rotator;

a pressure rotator configured to contact an outer surface of the endless fixing rotator;

a stay;

a biasing member having one end fixed to the stay; and a nip formation pad supported by the stay, disposed inside a loop of the endless fixing rotator, and configured to form a nip between the endless fixing rotator and the pressure rotator;

the nip formation pad including:

at least one engaged portion disposed at a position other than both ends of the nip formation pad in a longitudinal direction of the nip formation pad and configured to engage an engaging portion included in the stay to generate a first rotational moment; or engaged portions disposed at both ends of the nip formation pad in the longitudinal direction of the nip formation pad and configured to engage engaging portions included in the stay to generate a second rotational moment, wherein each of the first rotational moment and the second rotational moment is smaller than a rotational moment generated by engagement between an engaging portion included in the stay and an engaged portion disposed at only one end of the nip formation pad in the longitudinal direction of the nip formation pad.

2. The fixing device according to claim 1, wherein the biasing member is configured to push the nip formation pad in a short-side direction of the nip formation pad perpendicular to the longitudinal direction and in a direction away from the stay.

3. The fixing device according to claim 1, further comprising a temperature detector configured to detect a temperature of the heater, wherein the biasing member is configured to press the temperature detector against the nip formation pad.

4. The fixing device according to claim 1, wherein a relation $L3<L2/2$ is satisfied, where L2 is a distance in the longitudinal direction from a pressing position at which the biasing member presses the nip formation pad to one end of the nip formation pad that is nearer to the pressing position than the other end of the nip formation pad, and L3 is a distance in the longitudinal direction from the pressing position to the engaged portion of the nip formation pad.

5. The fixing device according to claim 4, wherein the engaged portion of the nip formation pad overlaps the pressing position in a short-side direction of the nip formation pad perpendicular to the longitudinal direction.

6. The fixing device according to claim 1, wherein the nip formation pad includes a plurality of engaged portions disposed in the longitudinal direction of the nip formation pad, and the plurality of engaged portions are configured to engage a plurality of engaging portions included in the stay to form a plurality of engagement portions.

7. The fixing device according to claim 6, wherein the nip formation pad has one half portion in the longitudinal direction from one end of the nip formation pad to a pressing position at which the biasing member presses the nip formation pad and the other half portion in the longitudinal direction from the other end of the nip formation pad to the pressing position, and wherein the plurality of engagement portions include at least one engagement portion in the one half portion and at least one engagement portion in the other half portion.

8. The fixing device according to claim 1, wherein the engaged portion of the nip formation pad is configured to engage the engaging portion of the stay to form an engagement positioner.

9. The fixing device according to claim 8, wherein the stay includes a snap-fit engaging portion.

10. The fixing device according to claim 1, further comprising a temperature detector configured to detect temperature of the heater, wherein the nip formation pad has an accommodating section that is a through hole to accommodate the temperature detector and wherein an inner wall of the accommodating section is not in contact with the temperature detector.

11. The fixing device according to claim 10, wherein the through hole has a diameter in a short-side direction of the nip formation pad larger than a diameter in the longitudinal direction of the nip formation pad, and wherein the short-side direction is perpendicular to the longitudinal direction.

12. The fixing device according to claim 1, wherein the stay has a central portion in the longitudinal direction protruding toward the nip formation pad with respect to both ends of the stay in the longitudinal direction.

13. The fixing device according to claim 1, wherein the nip formation pad has a central portion in the longitudinal direction protruding toward the stay with respect to both ends of the nip formation pad in the longitudinal direction.

14. The fixing device according to claim 1, wherein the nip formation pad holds the heater.

15. An image forming apparatus comprising the fixing device according to claim 1.

* * * * *